United States Patent [19]

Duffy

[11] Patent Number: 5,036,693

[45] Date of Patent: Aug. 6, 1991

[54] INTEGRAL FINNED TUBES AND A METHOD OF MANUFACTURING SAME

[75] Inventor: Patrick J. Duffy, Renfrewshire, Scotland

[73] Assignee: Babcock Energy Limited, London, England

[21] Appl. No.: 337,854

[22] Filed: Apr. 14, 1989

[30] Foreign Application Priority Data

Apr. 15, 1988 [GB] United Kingdom ..... 8808919

[51] Int. Cl.[5] ..... B21C 1/24

[52] U.S. Cl. ..... 72/283; 29/890.05

[58] Field of Search ..... 72/276, 283, 282, 278; 29/890.046, 890.05

[56] References Cited

U.S. PATENT DOCUMENTS 3,131,803 5/1964 Hill ..... 72/283

3,630,062 12/1971 Odaki ..... 72/283

FOREIGN PATENT DOCUMENTS 727859 2/1966 Canada ..... 29/890.05

2305975 9/1974 Fed. Rep. of Germany ..... 72/276

492276 5/1956 Italy ..... 29/890.05

*Primary Examiner*—Daniel C. Crane

*Attorney, Agent, or Firm*—Shlesinger, Arkwright & Garvey

[57] ABSTRACT

Manufacture of integral finned tube utilizing a succession of plugged convergent, cold draw die stages. To produce a tube with diametrically opposed integral fins an initial stage die has an exit with an approximately elliptical outer periphery to form a tube with diametrically opposed thicker, or bulged walls. An intermediate stage has an exit of generally circular periphery with a pair of part circular, diametrically opposed, recesses to form a tube with more pronounced bulges. A final stage die has an exit of generally circular periphery with a pair of diametrically opposed, straight sided recesses to form a tube with bulges constituting planar faced fins. Between each successive stage the circumferential extent of each bulge is reduced while the maximum thickness is increased.

6 Claims, 3 Drawing Sheets

INTEGRAL FINNED TUBES AND A METHOD OF MANUFACTURING SAME

This invention relates to a method of manufacturing integral fin metal tube by a cold drawing process and to tubes so manufactured.

It is known to produce integral fin tubes from hollow cylindrical metal tube by a hot forging or by a hot extrusion process.

It is also known to cold draw hollow cylindrical metal tube to produce hollow cylindrical tube of a lesser diameter and or wall thickness.

However, hitherto it has not been considered feasible to produce integral fin tube from a hollow cylindrical metal tube by a cold drawing process since the stress distribution around the tube arising from a wall thickness varying around the radial cross-sectional circumference has been thought to give rise to unacceptable gradients leading to a danger of tearing of the tube metal due to excessive sheer stresses.

According to the present invention, there is provided a method of manufacturing an integral fin tube by cold drawing a hollow cylindrical metal tube through a succession of plugged dies to produce a reduction in the internal diameter and a reduction in the wall thickness of the tube, in which at one or more locations around the tube wall a relatively thicker portion, or bulge, is formed in the tube wall and in successive stages of cold drawing the circumferential extent of the relatively thicker wall or bulge, portion, is reduced—such that in an ultimate stage, a fin is formed.

Figure 1:
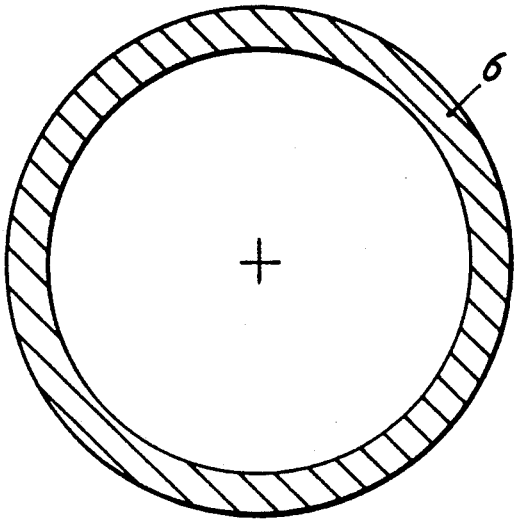
Figure 2:
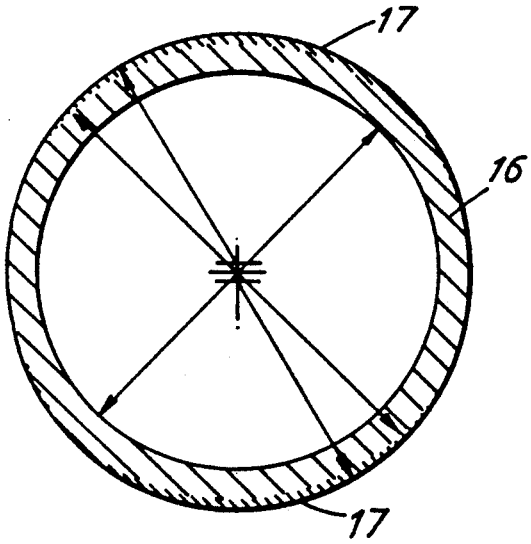
Figure 4:
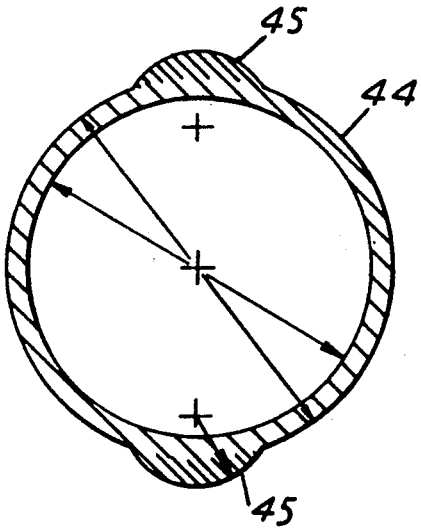
Figure 5:
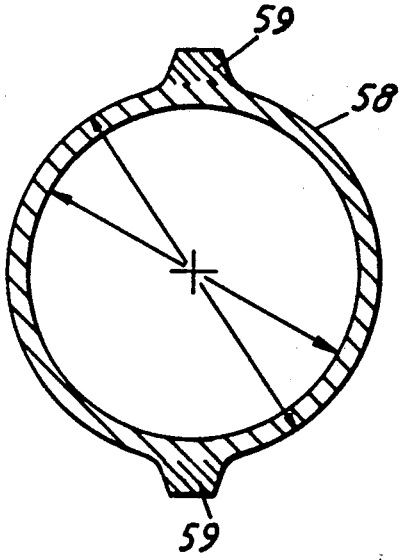
Figure 6:
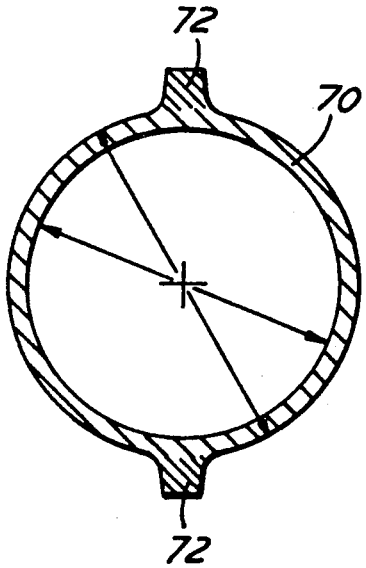

The method of cold drawing an integral fin tube will now be described, by way of example, with reference to the accompanying, partly diagrammatic drawings, in which:

FIGS. 1 to 6 are radial cross-sectional elevations of a hollow tube showing various stages in the production of a tube having diametrically opposed integral fins, FIG. 1 being the original tube and FIG. 6 being the finished tube; and FIGS. 7 to 11 are axial cross-sectional elevations of successive first, second, third, fourth and fifth dies through which the tube is drawn.

The dies are of a generally frusto-conical form, chamfered at entry and exit and converging from an entry position to a parallel-sided exit portion and each is provided with a respective plug (not shown) of rounded cylindrical form defining the internal diameter of the associated drawn tube.

Figure 7:
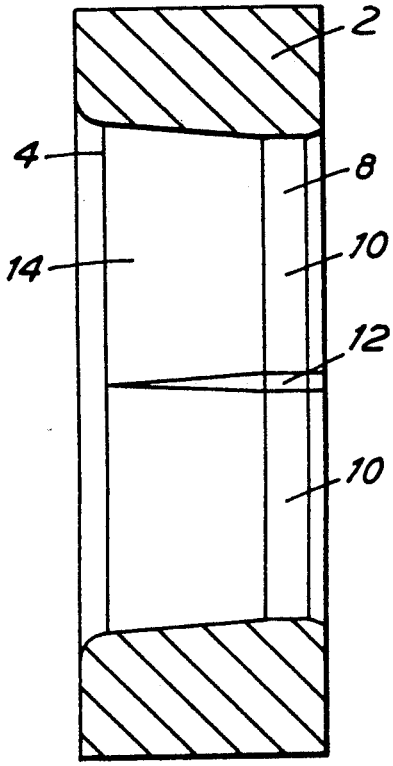

As shown in FIG. 7, the first die 2 has a circular cross-section entry portion 4 corresponding to the outer circumference of the original tube 6 shown in FIG. 1. The entry portion 4 converges smoothly to a parallel-sided exit portion 8 formed as two spaced semi-cylindrical surfaces 10 connected by a pair of short flat tangential faces 12, corresponding to the cross-section of the tube 16 shown in FIG. 2, the intervening portion 14 of generally frusto-conical form smoothly effecting the transformation from the entry portion 4 to the exit portion 8. This tube 16 has a wall with thicker, or bulged, portions 17 corresponding to the offset of the semi-cylindrical surfaces 10 of the die 2 from the tube central axis.

Figure 3:
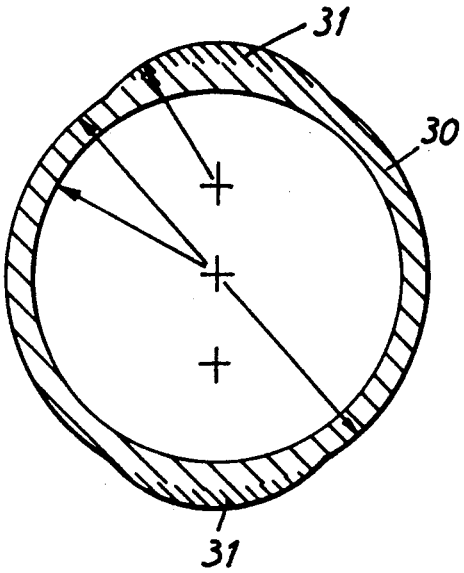
Figure 8:
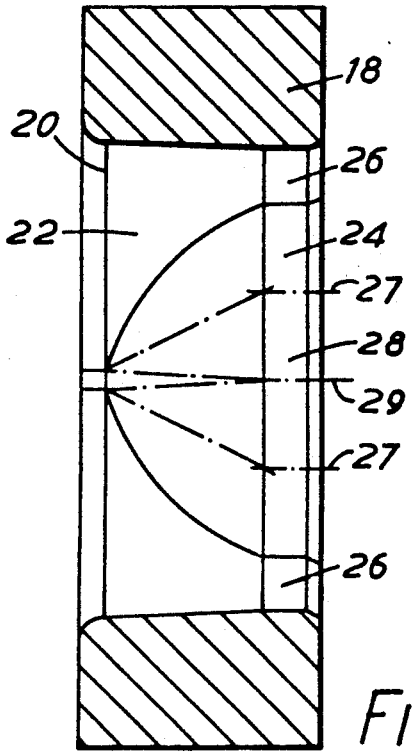

As shown in FIG. 8, the second die 18 has an entry portion 20 corresponding to the cross-section of the exit portion 8 of the first die 2 and smoothly transforms over a convergent portion 22 to a parallel-sided exit portion 24 formed as two, spaced, part cylindrical surfaces 26 having spaced axes 27 connected by, and merged with, a pair of further, part cylindrical, surfaces 28 having a common axis 29 to produce a cross-section corresponding to the cross-section of the tube 30 shown in FIG. 3 having bulged portions 31 of a lesser circumferential extent but greater thickness than the bulged portions 17 of the tube 16.

Figure 9:
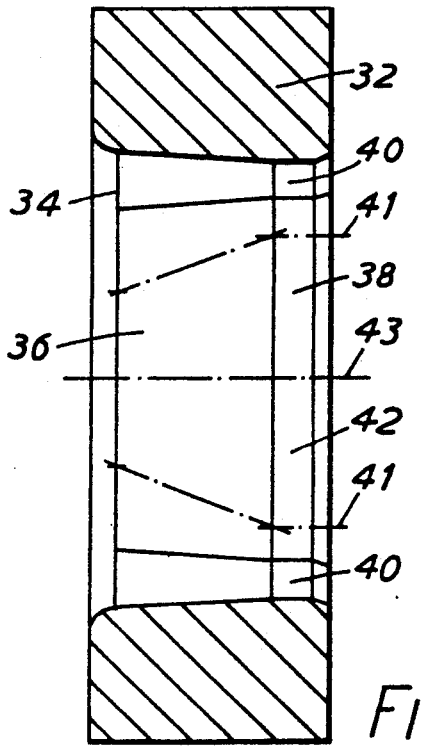

As shown in FIG. 9, the third die 32 has an entry portion 34 corresponding to the cross-section of the exit portion 24 of the second die 18 and smoothly transforms over a convergent portion 36 to a parallel-sided exit portion 38 formed as two, spaced, part cylindrical, surfaces 40 having spaced axes 41 connected by, and blended into, a pair of further, spaced, part cylindrical, surfaces 42 having a common axis 43 to produce a cross-section corresponding to the cross-section of the tube 44 shown in FIG. 4 having bulged portions 45 of a lesser circumferential extent but greater thickness than the bulged portions 31 of the tube 30.

Figure 10:
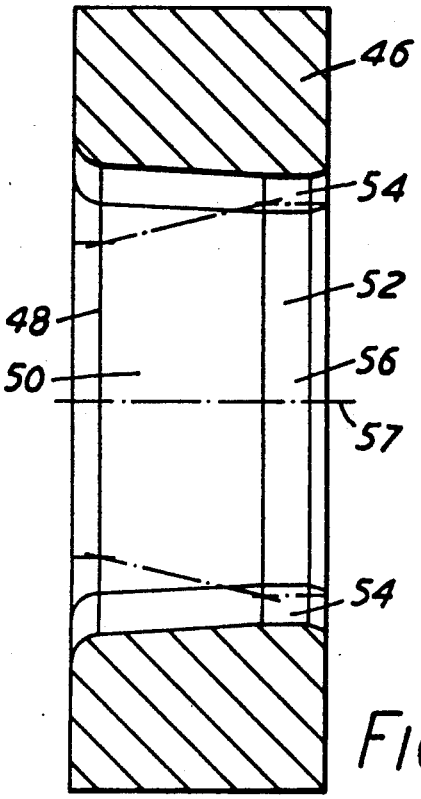

As shown in FIG. 10, the fourth die 46 has an entry portion 48 corresponding to the cross-section of the exit portion 38 of the second die 32 and smoothly transforms over a convergent portion 50 to a parallel-sided exit portion 52 formed as two, spaced straight sided grooves 54, converging outwardly, connected by and blended into a pair of spaced, part cylindrical surfaces 56 having a common axis 57 to produce a cross-section corresponding to the cross-section of the tube 58 shown in FIG. 5 having bulged portions 59 approximating to integral fins and of a lesser circumferential extent but greater thickness than the bulged portions 45 of the tube 44.

Figure 11:
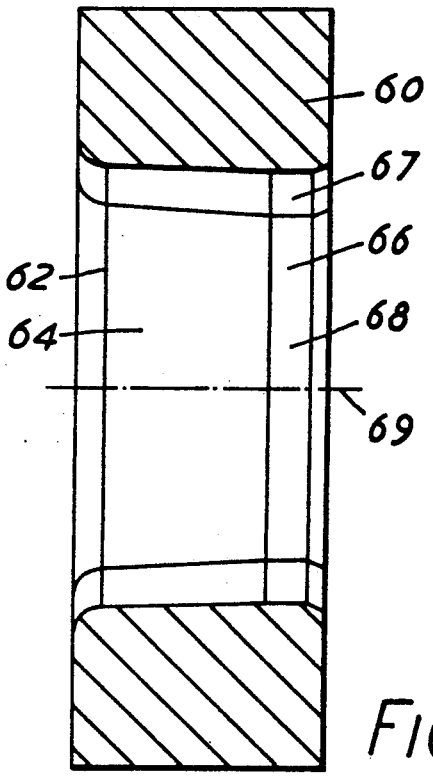

As shown in FIG. 11, the fifth die 60 has an entry portion 62 corresponding to the cross-section of the exit portion 52 of the second die 46 and smoothly transforms over a convergent portion 64 to a parallel-sided exit portion 66 formed as two, spaced straight sided grooves 67, converging outwardly, connected by and blended into a pair of spaced, part cylindrical surfaces 68 having a common axis 69 to produce a cross-section corresponding to the cross-section of the tube 70 shown in FIG. 6 having bulged portions 72 forming integral fins of a lesser circumferential extent but greater thickness than the bulged portions or fins 45 of the tube 44.

In operation, the respective first, second, third, fourth and fifth dies 2, 18, 32, 46 and 60 are mounted on draw benches and the tubes cold drawn down in a series of stages from the cross-section shown in FIG. 1 to that shown in FIG. 6.

Each successive cold drawn tube 16, 30, 44, 58 and 70 has a lesser internal and general external diameter and a lesser general wall thickness than the preceding one. Each successive tube 16, 30, 44, 58 and 70 has bulged portions 17, 31, 45, 59 and 72, that is, the portions outward of an imaginary hollow cylinder corresponding to the general outer diameter of the tube, of approximately the same cross-sectional area having a lesser circumferential extent but great radial thickness than the preceding one. The final cold drawing stage produces a tube 70 with cylindrical inner and outer surfaces and with diametrically opposed, planar faced, integral fins 72.

Each stage represents a reduction in the wall cross-sectional area of about 1.2 whilst the total reduction in the wall cross-sectional area from the original to the finished tube is about 3.2. The ratio of the cross-sectional area of the metal corresponding to a cylindrical hollow tube and the cross-sectional area of metal displaced as a bulge from the cylindrical tube cross-section is about 10 for each stage since, effectively, the bulge area moves toward the finished fin area at each successive draw decreasing in circumferential extent and increasing in maximum radial thickness. Thus the shear stresses arising within the metal of the tube wall are held within acceptable limits avoiding any tendency for tearing to arise.

It will be appreciated that whilst production of a tube having a pair of diametrically opposed, planar faced integral fins has been described, other cross-sectional forms and configurations—such as a single fin or three or four fins may be produced.

Furthermore, it will also be appreciated that the required effect may be produced in a lesser or greater number of passes through appropriately shaped dies depending upon the tube dimensions, the malleability of the metal and the power available on the draw benches.

I claim:

1. A method of manufacturing an integral fin tube from a plain surface tube by a succession of cold drawing operations through a plurality of plugged dies, the steps comprising:

a) cold drawing the tube through a first plugged die, said die being configured to form a pair of thickened oppositely disposed portions in the side wall of the tube while maintaining an internal cylindrical profile of the tube, each thickened portion extending a circumferential extent about the tube; and b) then cold drawing the same tube through a series of plugged dies each configured to increase thickness and radial outward extent of said portions while successively reducing the circumferential extent of said portions and reducing the inside and outside diameter and wall thickness of the major portion of the tube while maintaining the internal cylindrical profile throughout drawing through the series of dies.

2. A method of manufacturing an integral fin tube as claimed in claim 1, wherein each bulged portion of the tube wall is of approximately the same cross-sectional area.

3. A method of manufacturing an integral fin tube as claimed in claim 1, wherein each bulged portion of the tube wall is of a cross-sectional area approximately 10% of the cross-sectional area of the other portion of the tube wall corresponding to an imaginary hollow cylinder of the general outer diameter and inner diameter of the tube.

4. A method of manufacturing an integral fin tube as claimed in claim 1, wherein a reduction in the tube wall cross-sectional area by a factor of approximately 1.2 is effected at each cold drawing stage and a reduction in the tube wall cross-sectional area by a factor of approximately 3.2 is effected over the full cold drawing operation.

5. A method of manufacturing an integral fin tube as claimed in claim 1, wherein fins are formed at diametrically opposed locations.

6. A method of manufacturing an integral fin tube as claimed in claim 1, wherein the fin is formed with planar faces.

* * * * *